US008616856B2

(12) United States Patent
Matsuzaka et al.

(10) Patent No.: US 8,616,856 B2
(45) Date of Patent: Dec. 31, 2013

(54) AIR COMPRESSOR OF WATER INJECTION TYPE

(75) Inventors: Takehiro Matsuzaka, Shizuoka (JP); Hiroshi Ohta, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 794 days.

(21) Appl. No.: 12/709,275

(22) Filed: Feb. 19, 2010

(65) Prior Publication Data

US 2010/0233004 A1 Sep. 16, 2010

(30) Foreign Application Priority Data

Mar. 11, 2009 (JP) ..... 2009-057997

(51) Int. Cl.
*F04B 39/06* (2006.01)

(52) U.S. Cl.
USPC ..... 417/228; 417/292; 418/84; 418/97

(58) Field of Classification Search
None
See application file for complete search history.

(56) References Cited

U.S. PATENT DOCUMENTS

| | | | |
|---|---|---|---|
| 4,123,203 | A | 10/1978 | Kathmann et al. |
| 5,947,711 | A | 9/1999 | Myers et al. |
| 6,062,825 | A | 5/2000 | Chovan |
| 6,174,148 | B1 | 1/2001 | Suzuki |
| 6,695,602 | B2 | 2/2004 | Sundstroem et al. |
| 2003/0180150 | A1* | 9/2003 | Nishimura et al. ..... 417/44.2 |
| 2008/0166253 | A1* | 7/2008 | Fujimoto et al. ..... 418/201.1 |

FOREIGN PATENT DOCUMENTS

| | | | |
|---|---|---|---|
| CN | 201162651 | Y | 12/2008 |
| DE | 26 58 047 | A1 | 6/1978 |
| EP | 0 172 430 | A1 | 2/1986 |
| EP | 0814 267 | A1 | 12/1997 |
| EP | 0 974 754 | A2 | 1/2000 |
| EP | 1043791 | A2 * | 10/2000 |
| JP | 04-128595 | | 4/1992 |
| JP | 10-141262 | A | 5/1998 |
| JP | 2000-315515 | | 11/2000 |
| JP | 2008-95643 | A | 4/2008 |
| JP | 4475369 | B2 | 3/2010 |
| WO | WO 01/75310 | A1 | 10/2001 |

OTHER PUBLICATIONS

"IEEE 100 The Authoritative Dictionary of IEEE Standards Terms", The Institute of Electrical and Electronics Engineers, Inc., Seventh Edition, New York, NY, 2000, p. 234.*
European Search Report with English translation dated Dec. 6, 2011 (fourteen (14) pages), BE 201000085.
Japanese Office Action mailed Jan. 8, 2013 and partial English translation thereof.

* cited by examiner

*Primary Examiner* — Devon Kramer
*Assistant Examiner* — Philip Stimpert
(74) *Attorney, Agent, or Firm* — Crowell & Moring LLP

(57) ABSTRACT

In a water injection air compressor including a compressor main body for compressing air, a water-feed line for feeding water to an actuation chamber in the compressor main body, an air release valve for releasing the compressed air from the compressor main body, and a control panel for executing an on-load operation mode in which water is fed into the actuation chamber and an air release valve is closed and a no-load operation mode in which the water is fed into the actuation chamber and the air release valve is opened, wherein the control panel further executes a dry operation mode in which the water is prevented from being fed into the actuation chamber and with the air release valve is opened.

7 Claims, 14 Drawing Sheets

AIR COMPRESSOR OF WATER INJECTION TYPE

INCORPORATION BY REFERENCE

The present application claims priority from Japanese application JP2009-057997 filed on Mar. 11, 2009, the content of which is hereby incorporated by reference into this application.

BACKGROUND OF THE INVENTION

The present invention relates to a water injection air compressor configured to feed water to an actuation chamber in a compressor main body.

Conventional water injection air compressors are disclosed which enable an increase in compression efficiency by feeding water to the actuation chamber in the compressor main body, without the need to mix oil into compressed air (see, for example, JP-A-2008-95643).

BRIEF SUMMARY OF THE INVENTION

In the water injection air compressor, even when the compressor main body is stopped to halt feeding water to the actuation chamber, water may remain in the actuation chamber in the compressor main body or the humidity in the actuation chamber may increase. Thus, metal components inside the actuation chamber may be corroded. Conventionally known methods for preventing the metal components from being corroded involve using a corrosion-resistant material such as stainless steel or copper alloy or subjecting the components to surface treatment such as plating or coating. However, in spite of such corrosion measures, corrosion factors are present. That is, for example, in regard to water quality, if water contains chloride ions, stainless steel may be corroded. If water contains ammonia, the copper alloy may be corroded. Furthermore, the following are possible: crevice corrosion, which is likely to occur in the gap between the components, and galvanic corrosion, which is likely to occur between different types of metal. Additionally, defects (blow holes) may occur during surface treatment such as plating or coating. Even in such a case, corrosion occurs.

An object of the present invention is to provide a water injection air compressor configured to be able to prevent the interior of the compressor main body from being corroded.

(1) In order to accomplish the object, the present invention provides a water injection air compressor comprising a compressor main body configured to compress air, a water-feed line configured to be able to feed water to an actuation chamber in the compressor main body, an air release valve configured to be able to release compressed air ejected from the compressor main body, and control means for executing an on-load operation mode in which the compressor main body is allowed to perform the on-load operation with water fed to the actuation chamber in the compressor main body and with the air release valve closed and a no-load operation mode in which the compressor main body is allowed to perform a no-load operation with water fed to the actuation chamber in the compressor main body and with the air release valve open, wherein the control means executes a dry operation mode in which the compressor main body is allowed to perform a no-load operation with without water feeding to the actuation chamber in the compressor main body stopped and with the air release valve open.

(2) In (1), preferably, the control means executes the dry operation mode before the compressor is stopped in accordance with a stop instruction.

(3) In (2), preferably, the water injection air compressor further comprises pressure detecting means for detecting an ejection pressure of the compressor main body, and in accordance with the stop instruction, the control means determines whether or not the ejection pressure detected by the pressure detecting means is equal to or lower than a preset predetermined threshold, and if the ejection pressure exceeds the predetermined threshold, the control means executes the no-load operation mode, and after the ejection pressure becomes equal to or lower than the predetermined threshold, executes the dry operation mode, and then stops the compressor.

(4) In (2), preferably, the water injection air compressor further comprises temperature detecting means for detecting an ejection temperature of the compressor main body, and in accordance with a stop instruction, the control means determines whether or not the ejection temperature detected by the temperature detecting means is equal to or lower than a preset predetermined threshold, and if the ejection temperature exceeds the predetermined threshold, the control means executes the no-load operation mode, and after the ejection temperature becomes equal to or lower than the predetermined threshold, executes the dry operation mode, and then stops the compressor.

(5) In any one of (1) to (4), preferably, the control means executes the dry operation mode in response to every elapse of predetermined time period, during which time period the actuation of the actuation chamber is prevented.

(6) In any one of (1) to (4), preferably, the control means executes the dry operation mode at a preset time during the stop period of the compressor.

(7) In any one of (1) to (6), preferably, the control means executes the dry operation mode in accordance with an instruction input by an operator via operation means while the compressor is stopped.

(8) In any one of (1) to (7), preferably, the control means switches to the dry operation mode when a duration of the no-load operation mode reaches a preset first predetermined time, and halts the compressor main body when the duration of the dry operation mode reaches a preset second predetermined time.

(9) In (8), preferably, the water injection air compressor further comprises pressure detecting means for detecting the ejection pressure of the compressor main body, and when the duration of the no-load operation mode reaches the preset first predetermined time and the ejection pressure detected by the pressure detecting means is equal to or lower than a preset predetermined threshold, the control means switches to the dry operation mode.

(10) In (9), preferably, the control means switches to the no-load operation mode if the ejection pressure detected by the pressure detecting means exceeds the predetermined threshold during the dry operation mode.

(11) In (8), preferably, the water injection air compressor further comprises temperature detecting means for detecting the ejection temperature of the compressor main body, and when the duration of the no-load operation mode reaches the preset first predetermined time and the ejection temperature detected by the temperature detecting means is equal to or lower than a preset predetermined threshold, the control means switches to the dry operation mode.

(12) In (11), preferably, the control means switches to the no-load operation mode if the ejection temperature detected by the temperature detecting means exceeds the predetermined threshold during the dry operation mode.

(13) In any one of (1) to (12), preferably, the control means executes the dry operation mode every time a halt time for the compressor main body reaches a preset third predetermined time.

The present invention can prevent the interior of the compressor main body from being corroded.

Other objects, features and advantages of the invention will become apparent from the following description of the embodiments of the invention taken in conjunction with the accompanying drawings.

DETAILED DESCRIPTION OF THE INVENTION

A first embodiment of the present invention will be described with reference to the drawings.

Figure 1:
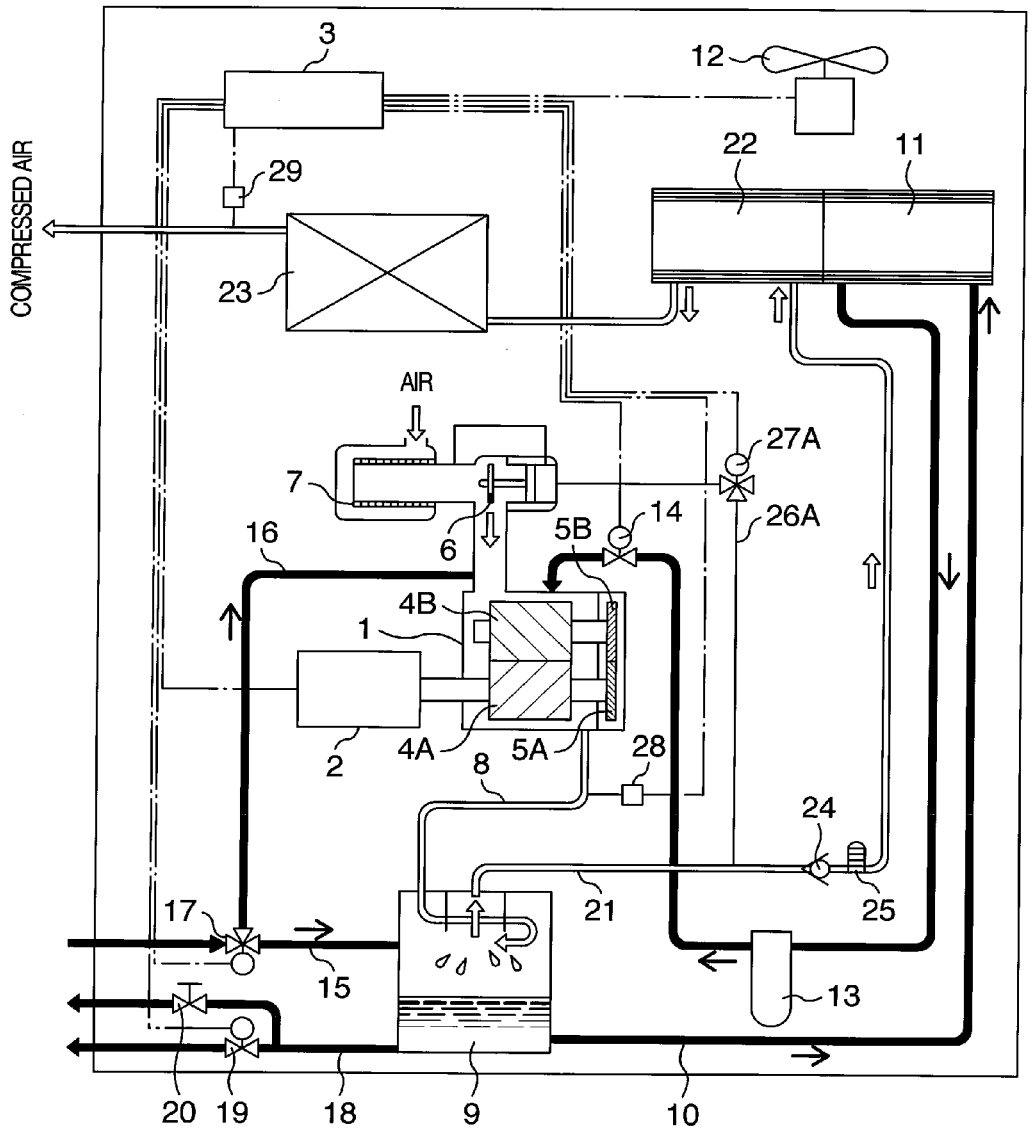
FIG. 1 is a diagram illustrating the configuration of a water injection air compressor according to a first embodiment of the present invention.

FIG. 1 is a diagram illustrating the configuration of a water injection air compressor according to the present embodiment.

In FIG. 1, a water injection air compressor (compressor unit) includes a compressor main body 1, a motor configured to drive the compressor main body 1, and a control panel 3 configured to control the whole compressor including the motor 2. The compressor main body 1 includes a pair of male and female screw rotors 4A and 4B rotatably supported via a bearing ((not shown in the drawings; for example, a bearing of an oil lubricated type). When the rotating power of the motor 2 is transmitted to the screw rotor 4A, timing gears 5A and 5B allow the screw rotors 4A and 4B to rotate, respectively, in a non-contact manner. Thus, an actuation chamber formed between the tooth grooves of the screw rotors 4A and 4B move to allow air sucked into the actuation chamber to be compressed and ejected.

A suction throttle valve 6 and a suction filter 7 are provided on a suction side of the compressor main body 1. Furthermore, a separator tank 9 is connected to an ejection side of the compressor main body 1 via an ejection pipe 8. The separator tank 9 separates compressed air ejected from the compressor main body 1, from water contained in the compressed air.

The water separated by the separator tank 9 is temporarily stored in the lower portion of the separator tank 9. The water is then guided out to an air cooling water cooler 11 via a water pipe 10 by means of discharge pressure from the compressor main body 1. The water is then cooled by cooling wind induced by a cooling fan 12. A water filter 13 is then used to remove impurities from the water cooled by the water cooler 11. The resultant water is injected into the actuation chamber in the compressor main body 1. A water-feed valve 14 is provided downstream of the water filter 13.

Furthermore, refill pipes 15 and 16 are provided which are configured to externally feed water into the suction side of the separator tank 9 and the compressor main body 1 if for example, the amount of water stored in the separator tank 9 decreases. An electric three-way valve 17 is provided at a branching portion between the refill pipes 15 and 16. Additionally, a drain pipe 18 is provided to discharge the water stored in the separator tank 9. An electric drain valve 19 and a manual drain valve 20 are provided in the drain pipe 18.

The compressed air resulting from the separation in the separator tank 9 is guided out to an after cooler via a compressed air pipe 21. The compressed air is then cooled by the cooling wind induced by the cooling fan 12. The compressed air cooled by the after cooler 22 is guided out to a dryer 23, in which the compressed air is dehumidified. The dehumidified air is then supplied to a user. Additionally, a check valve 24 and a regulator valve 25 are provided upstream of the after cooler 22 in the compressed air pipe 21 (in other words, on a secondary side of the separator tank 9). An air release pipe 26A is also provided which branches upstream of the check valve 24 in the compressed air pipe 21. An air release valve 27A configured to be able to release compressed air is provided in the air release pipe 26A. The air release valve 27A and the suction throttle valve 6 are interlocked with each other. If the air release valve 27A is closed, the suction throttle valve 6 is open. If the air release valve 27A is open, the suction throttle valve 6 is closed.

Furthermore, an ejection pressure sensor 28 is provided in the ejection pipe 8 to detect the ejection pressure of the compressor main body 1. A supply pressure sensor 29 is provided downstream of the dryer 23 in the compressed air pipe 21 to detect a supply pressure. The control panel 3 is configured to receive detection signals from the ejection pressure sensor 28 and the supply pressure sensor 29 and to switch an operation mode based on the detection signals.

Figure 2:
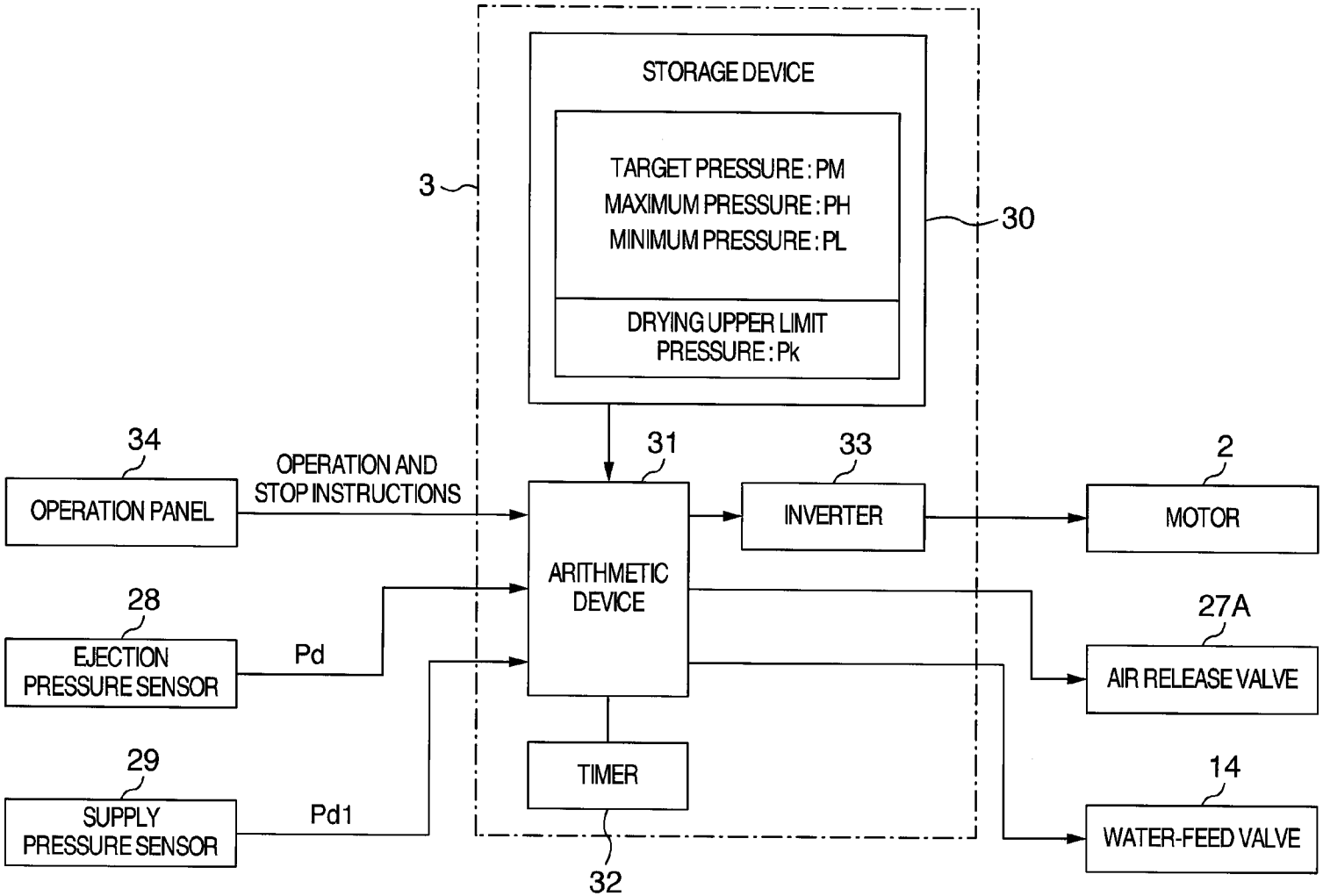
FIG. 2 is a block diagram illustrating the functional configuration of a control panel according to the first embodiment of the present invention together with related devices.

FIG. 2 is a block diagram illustrating the functional configuration of the control panel 3 relating to switching control for the operation mode together with related devices.

In FIG. 2, the control panel 3 includes a storage device 30, an arithmetic device 31, a timer 32, and an inverter 33. The arithmetic device 31 is configured to receive an operation instruction (or a stop instruction) to start (or stop) an operation of the compressor unit if for example, an operator operates an operation button (or a stop button) on an operation panel 34.

While the compressor unit is in operation, the arithmetic device 31 receives a detection signal from the supply pressure sensor 29 and executes an on-load operation mode, no-load operation mode, or a halt mode based on the detection signal. As the control range of a supply pressure Pd1, for example, a target pressure PM=0.79 MPa (abs), the maximum pressure PH=0.88 MPa (abs), and the minimum pressure PL=0.70 MPa (abs) are set and stored in the storage device 30. These set values are control references and can be set by inputs via the operation panel 34. In the on-load operation mode, the arithmetic device 31 opens the water-feed valve 14 to feed water to the actuation chamber in the compressor main body 1. Furthermore, the arithmetic device 31 closes the air release valve 27A (in conjunction with the closure, the suction throttle valve 6 is opened), while driving the motor 2 to allow the compressor main body 1 to perform the on-load operation. At this time, the arithmetic device 31 performs a PID operation based on the deviation between the supply pressure Pd1 detected by the supply pressure sensor 29 and the target pressure PM. Then, based on the value obtained, the rotation number of the motor 2 is variably controlled by the inverter 33. Hence, the supply pressure Pd1 becomes almost equal to the target pressure PM.

However, a significant decrease in the amount of compressed air used by the user increases the supply pressure Pd1 even though the rotation number of the motor 2 is reduced to the minimum value. When the supply pressure Pd1 reaches the maximum pressure PH, the arithmetic device switches to the no-load operation mode. In the no-load operation mode, as is the case with the on-load operation mode, the arithmetic device 31 opens the water-feed valve 14 to feed water to the actuation chamber in the compressor main body 1. Furthermore, the arithmetic device 31 opens the air release valve 27A (in conjunction with the opening, the suction throttle valve 6 is closed), while reducing the rotation number of the motor 2 to the minimum value to allow the compressor main body 1 to perform a no-load operation.

The arithmetic device 31 then determines whether or not the supply pressure Pd1 decreases to below the minimum pressure PL or less during the no-load operation mode. For example, if the supply pressure Pd1 decreases to the minimum pressure PL, the arithmetic device 31 switches to the on-load operation mode. On the other hand, for example, if the supply pressure Pd1 does not decrease to the minimum pressure PL, the arithmetic device 31 continues the no-load operation mode. The arithmetic device 31 uses a timer 32 to calculate the time for which the no-load operation is continued. Then, the duration of the no-load operation mode reaches a preset predetermined time, the arithmetic device 31 switches to the halt mode. In the halt mode, the arithmetic device 31 closes the water-feed valve 14 to stop feeding water to the actuation chamber in the compressor main body 1. The arithmetic device 31 also stops the motor 2 and thus the compressor main body 1. Additionally, in the halt mode, if the supply pressure Pd1 decreases to the minimum pressure PL, the arithmetic device 31 switches to the on-load operation mode.

Here, the major characteristic of the present embodiment is that the arithmetic device 31 executes the dry operation mode before the compressor unit is stopped in accordance with a stop instruction from the operation panel 34. In the dry operation mode, the arithmetic device 31 closes the water-feed valve 14 to stop feeding water to the actuation chamber in the compressor main body 1. Furthermore, as in the case with the no-load operation mode, the arithmetic device 31 opens the air release valve 27A (in conjunction with the opening, the suction throttle valve 6 is closed), while reducing the rotation number of the motor 2 to the minimum value to allow the compressor main body 1 to perform a no-load operation. This control procedure will be described with reference to FIG. 3.

Figure 3:
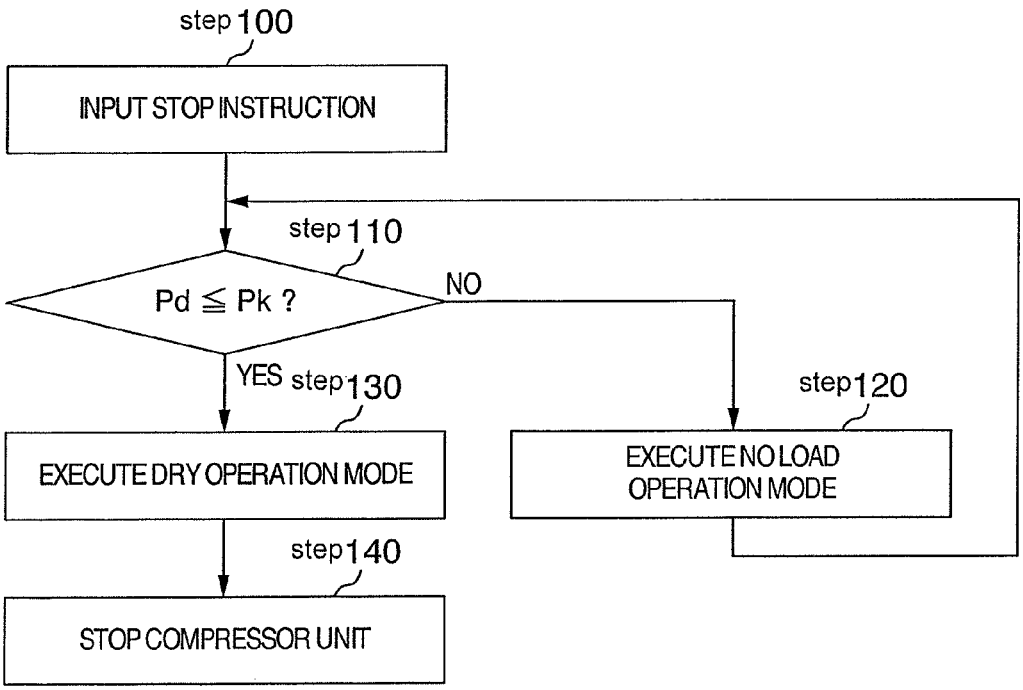
FIG. 3 is a flowchart illustrating the contents of control processing executed by an arithmetic device in the control panel according to the first embodiment of the present invention.

FIG. 3 is a flowchart illustrating the contents of control processing executed by the arithmetic device 31 according to the present embodiment.

When a stop instruction is input via the operation panel 34 in step 100, the arithmetic device 31 proceeds to step 110 to determine whether or not an ejection pressure Pd detected by the ejection pressure sensor 28 is equal to or lower than a drying upper-limit pressure Pk (as shown in FIG. 2 described above, a predetermined threshold preset and stored in the storage device 30; for example, Pk=0.11 MPa (abs)). For example, if the ejection pressure Pd exceeds the drying upper limit pressure Pk, the result of the determination in step 110 is negative, and the arithmetic device 31 proceeds to step 120 to execute the no-load operation mode. Specifically, for example, if the stop instruction is input during the on-load operation mode, since the ejection pressure Pd normally exceeds the drying upper limit pressure Pk, the arithmetic device 31 switches to the no-load operation mode. Furthermore, for example, even when the stop instruction is input during the no-load operation mode, if the ejection pressure Pd exceeds the drying upper limit pressure Pk, then in step 120, the arithmetic device 31 continues the no-load operation mode until the result of the determination in step 100 becomes affirmative.

For example, in step 110, if the ejection pressure Pd is equal to or lower than the drying upper limit pressure Pk, the result of the determination is affirmative. The arithmetic device 31 thus proceeds to step 130 to switch to the dry operation mode. Thereafter, the arithmetic device 31 uses the timer 32 to calculate the duration of the dry operation mode. When the duration of the dry operation mode reaches a preset predetermined time to (for example, 1 minute to 5 minutes), the arithmetic device 31 proceeds to step 140 to stop the compressor unit.

Figure 4:
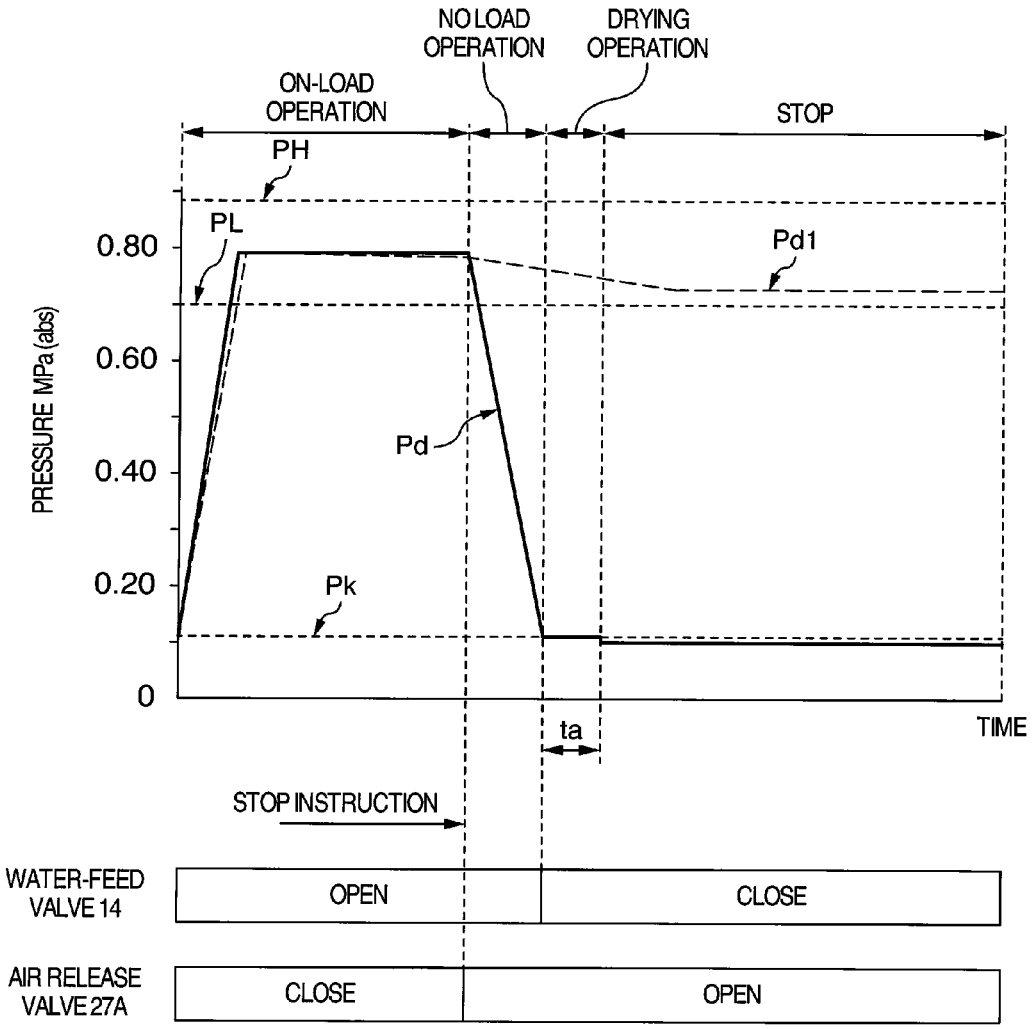
FIG. 4 is a time chart illustrating an operation according to the first embodiment of the present invention.

The operation of the present embodiment will be described with reference to FIG. 4. FIG. 4 is a time chart for illustrating the operation according to the present embodiment.

For example, when the operator operates the operation button on the operation panel 34, the compressor unit starts operating to come into the on-load operation mode. In the on-load operation mode, the arithmetic device 31 opens the water-feed valve 14 to feed water to the actuation chamber in the compressor main body 1. The arithmetic device 31 further closes the air release valve 27A (and opens the suction throttle valve 6) to variably control the rotation number of the motor 2 to allow the compressor main body 1 to perform the on-load operation.

For example, when the operator operates the stop button on the operation panel 34 during the on-load operation mode, since the ejection pressure Pd exceeds the drying upper limit pressure Pk=0.11 MPa (abs), the arithmetic device 31 switches to the no-load operation mode (steps 100 to 120 in FIG. 3 described above). In the no-load operation mode, the arithmetic device 31 opens the water-feed valve 14 to feed water to the actuation chamber in the compressor main body 1. The arithmetic device 31 further opens the air release valve 27A (and closes the suction throttle valve 6) to reduce the rotation number of the motor 2 to the minimum value, thus allowing the compressor main body 1 to perform a no-load operation.

When the ejection pressure Pd is equal to or lower than the drying upper limit pressure Pk, the arithmetic device 31 switches to the dry operation mode (step 130 in FIG. 3 described above). In the dry operation mode, the arithmetic device 31 closes the water-feed valve 14 to stop feeding water to the actuation chamber in the compressor main body 1. The arithmetic device 31 further opens the air release valve 27A (and closes the suction throttle valve 6) to reduce the rotation number of the motor 2 to the minimum value, thus allowing the compressor main body 1 to perform a no-load operation. Thereafter, when the duration of the dry operation mode reaches the preset predetermined time ta, the compressor unit is stopped (step 140 in FIG. 3 described above).

Thus, in the present embodiment, the dry operation mode is executed before the compressor unit is stopped. This allows the interior of the compressor main body 1 to be dried. Hence, the interior of the compressor main body 1 can be prevented from being corroded while the compressor unit is stopped. Furthermore, for example, in a cold region, the present embodiment can prevent water remaining inside the compressor main body from disadvantageously freezing to make the compressor inoperative.

Furthermore, in the present embodiment, if the ejection pressure Pd exceeds the drying upper limit pressure Pk, the no-load operation mode is executed. Then, when the ejection pressure Pd is equal to or lower than the drying upper limit pressure Pk, the no-load operation mode is switched to the dry operation mode. Hence, the present embodiment can suppress possible adverse effects on compression performance. This will be described below in detail.

A relational expression for a pressure ratio obtained by theoretical adiabatic pressure and the temperature of ejected air when not feeding water to the actuation chamber in the compressor main body 1 is expressed by Expression 1 shown below. In Expression 1, Td denotes the ejected air temperature (K), Ts denotes the temperature of sucked air temperature (K), Pd denotes the pressure of ejected air (MPa (abs)), Ps denotes the pressure of sucked air (MPa (abs)), (k) denotes a specific heat ratio, and (m) denotes a compression coefficient.

$$Td = Ts \times \left(\frac{Pd}{Ps}\right)^{\frac{k-1}{mk}} \quad \text{[Expression 1]}$$

Figure 5:
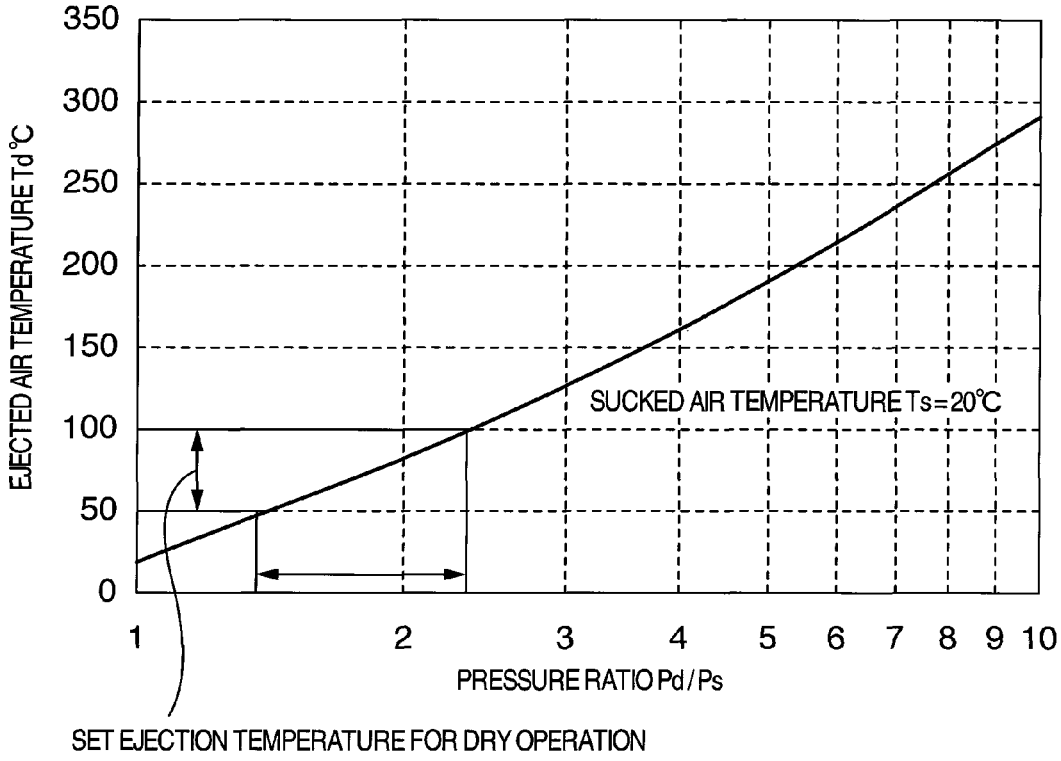
FIG. 5 is a characteristic diagram illustrating a pressure ratio and an ejected air temperature.

FIG. 5 is a characteristic diagram illustrating the relationship between the pressure ratio Pd/Ps and the ejected air temperature Td (° C.) determined by Expression 1. In FIG. 5, the following are assumed: the specific heat ratio (k)=1.4, the compression coefficient (m)=1, and the ejected air temperature Ts 295k=20° C.

For example, it is assumed that the compressor main body 1 is allowed to perform the on-load operation without feeding water to the actuation chamber in the compressor main body 1. Then, when the ejected air pressure Pd=0.80 MPa (abs) and the sucked air pressure Ps=0.10 MPa (abs) (atmospheric pressure) (that is, when the pressure ratio Pd/Ps=8), the ejected air temperature Td=256° C. However, in the actual on-load operation mode, the compressor main body 1 is allowed to perform the on-load operation with water fed to the actuation chamber in the compressor main body 1. Thus, the ejected air temperature Td decreases down to about 60° C.

Furthermore, for example, it is assumed that the compressor main body 1 is allowed to perform a no-load operation with no water fed to the actuation chamber in the compressor main body 1. Then, given that a small amount of pressure remains in the actuation chamber in the compressor main body 1, when the ejected air pressure Pd=0.30 MPa (abs) and the sucked air pressure Ps=0.05 MPa (abs) (that is, when the pressure ratio Pd/Ps=6), the ejected air temperature Td=216° C. Thus, if the dry operation mode is executed under this temperature condition, then the screw rotors 4A and 4B need to be pre-designed so as to enlarge the gap between the members thereof taking the possible thermal expansion thereof into account. This affects compression efficiency. On the other hand, if the pressure in the actuation chamber in the compressor main body 1 decreases and when the ejected air pressure Pd=0.11 MPa (abs) and the sucked air pressure Ps=0.05 MPa (abs) (that is, when the pressure ratio Pd/Ps=2.2), the ejected air temperature Td decreases down to 94° C. Therefore, when the dry operation mode is executed under this temperature condition (for example, within the range from 50° C. to 100° C.), the screw rotors 4A and 4B need not be pre-designed so as to extremely enlarge the gap between the members thereof. Hence, the present embodiment can suppress the possible adverse effects on compression efficiency.

Figure 6:
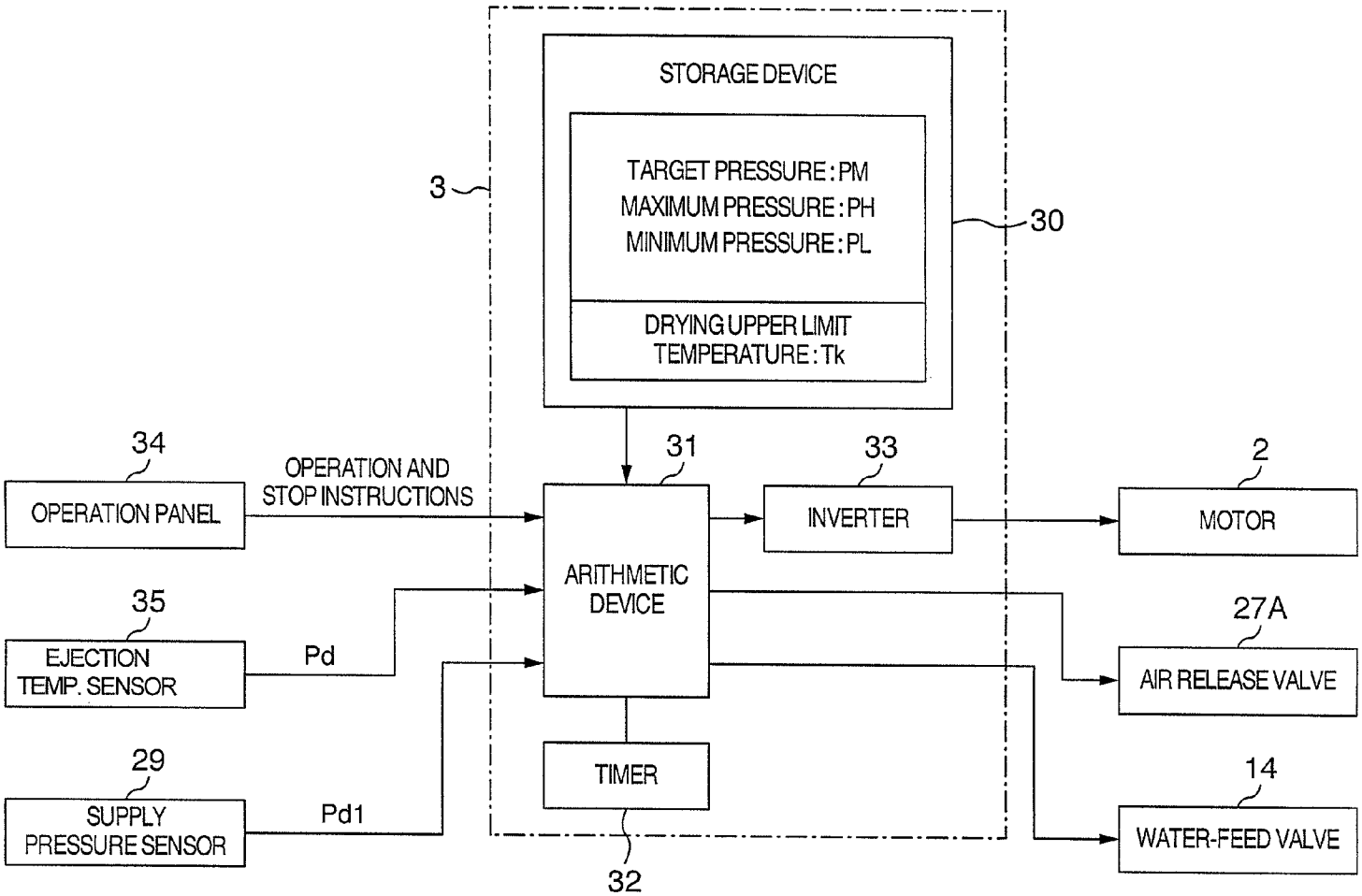
FIG. 6 is a block diagram illustrating the functional configuration of the control panel according to a first modification of the present invention together with related devices.

In the first embodiment, the following control arrangement has been described by way of example. The arithmetic device 31 in the control panel 3 determines whether or not ejection pressure Pd detected by the ejection pressure sensor 28 is equal to or lower than the drying upper limit pressure Pk. If the ejection pressure Pd exceeds the drying upper limit pressure Pk, the arithmetic device 31 executes the no-load operation mode. Then, when the ejection pressure Pd is equal to or lower than the drying upper limit pressure Pk, the arithmetic device 31 executes the dry operation mode. However, the present invention is not limited to this control arrangement. That is, for example, as shown in FIG. 6, an ejection temperature sensor 35 configured to detect the ejection temperature Td of the compressor main body 1 may be provided. Then, the arithmetic device 31 in the control panel 3 may determine whether or not the ejection temperature Td detected by the ejection temperature sensor 35 is equal to or lower than a drying upper limit temperature Tk (a predetermined threshold preset and stored in the storage device 30; for example, 100° C.). If the ejection temperature Td exceeds the drying upper limit temperature Tk, the arithmetic device 31 executes the no-load operation mode. Then, when the ejection temperature Td is equal to or lower than the drying upper limit temperature Tk, the arithmetic device 31 may execute the dry operation mode. Also in this case, effects similar to those of the first embodiment can be exerted.

Figure 7:
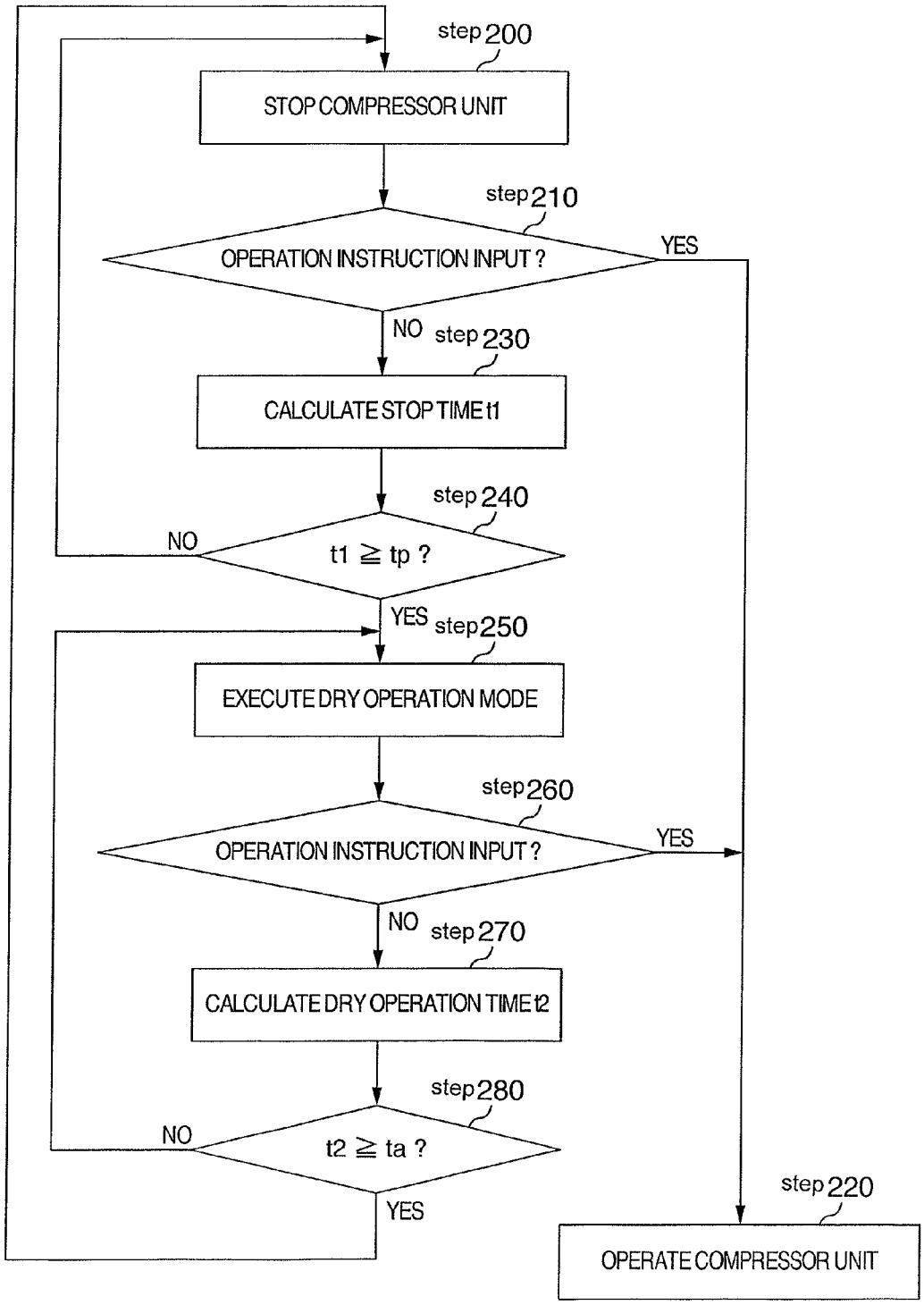
FIG. 7 is a flowchart illustrating the contents of control processing executed by the arithmetic device in the control panel according to a second embodiment of the present invention.
Figure 8:
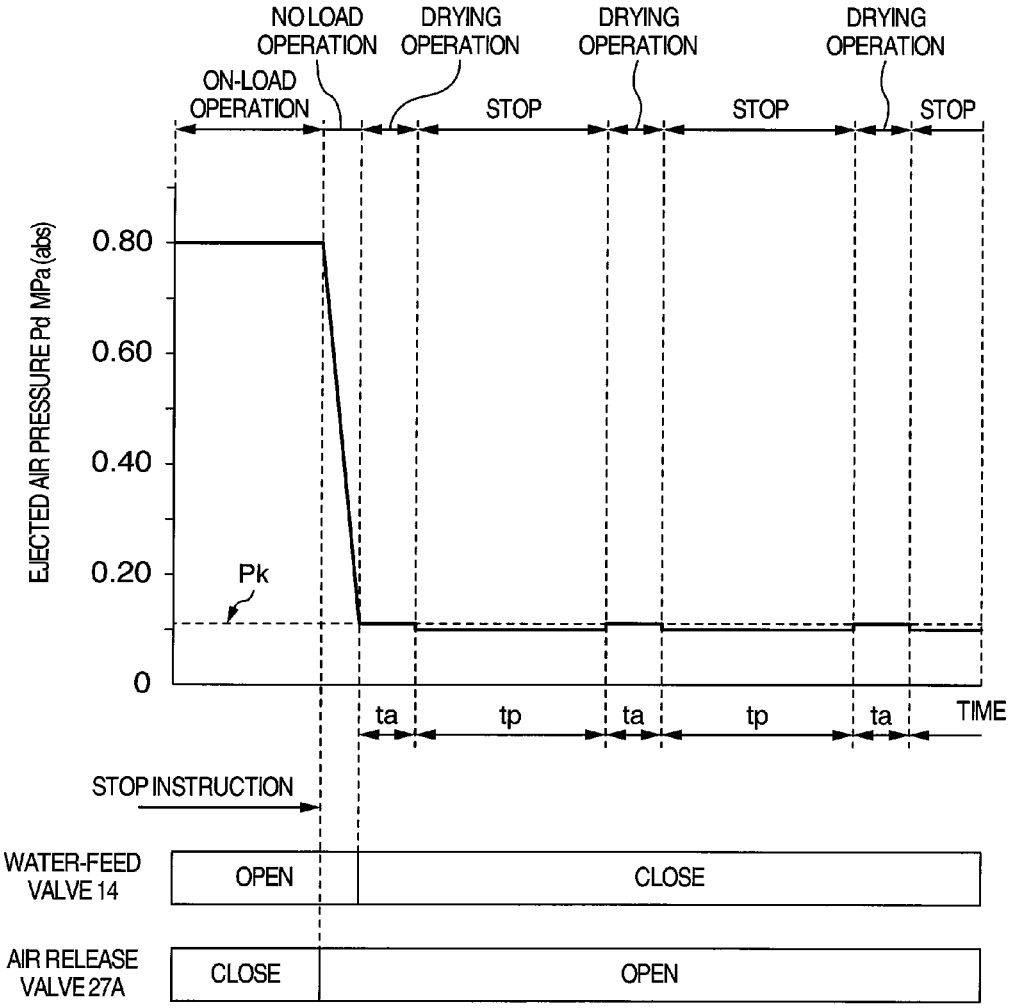
FIG. 8 is a time chart illustrating an operation according to the second embodiment of the present invention.

A second embodiment of the present invention will be described with reference to FIGS. 7 and 8. In the present embodiment, components equivalent to those in the first embodiment are denoted by the same reference numerals. The description of these components is appropriately omitted.

In the present embodiment, the arithmetic device 31 in the control panel executes the drying operation mode while the compressor unit is stopped. This control procedure will be described with reference to FIG. 7. FIG. 7 is a flowchart illustrating the contents of control processing executed by the arithmetic device 31 according to the present embodiment.

In step 200, the arithmetic device 31 stops the compressor unit 200. The arithmetic device 31 then proceeds to step 210 to determine whether or not an operation instruction has been input via the operation panel 34. For example, if an operation instruction has been input via the operation panel 34, the result of the determination in step 210 is affirmative. The arithmetic device 31 thus proceeds to step 220 to start operating the compressor unit (in other words, the arithmetic device 31 executes the on-load operation mode). On the other hand, for example, if no operation instruction has been input via the operation panel 34, the result of the determination in step 210 is negative. The arithmetic device 31 thus shifts to step 230.

In step 230, the arithmetic device 31 uses the timer 32 to calculate the time t1 for which the compressor unit has been stopped. The arithmetic device 31 then proceeds to step 240 to determine whether or not the stop time t1 is equal to or longer than a preset predetermined time tp. For example, if the stop time t1 is shorter than the predetermined time tp, the result of the determination in step 240 is negative. The arithmetic device 31 thus returns to step 200 to repeat a procedure similar to that described above. On the other hand, if the stop time t1 is equal to or longer than the predetermined time tp, the result of the determination in step 240 is affirmative. The arithmetic device 31 thus proceeds to step 250 to execute the dry operation mode.

Then, the arithmetic device 31 proceeds to step 260 to determine whether or not an operation instruction is input via the operation panel 34 during the dry operation mode. For example, if an operation instruction has been input via the operation panel 34, the result of the determination in step 260 is affirmative. The arithmetic device 31 thus proceeds to step 220 to start operating the compressor unit (in other words, switch to the on-load operation mode). On the other hand, for example, if no operation instruction has been input via the operation panel 34, the result of the determination in step 260 is negative. The arithmetic device 31 thus shifts to step 270.

In step 270, the arithmetic device 31 uses the timer 32 to calculate the duration t2 of the dry operation mode. The arithmetic device 31 then proceeds to step 280 to determine whether or not the duration t2 of the dry operation mode is equal to or longer than the preset predetermined time ta. For example, if the duration t2 is shorter than the predetermined time ta, the result of the determination in step 280 is negative. The arithmetic device 31 thus returns to step 250 to repeat a procedure similar to that described above. On the other hand, if the duration t2 is equal to or longer than the predetermined time ta, the result of the determination in step 280 is affirmative. The arithmetic device 31 thus returns to step 200 to stop the compressor unit.

The operation of the present embodiment will be described with reference to FIG. 8. FIG. 8 is a time chart illustrating an operation according to the present embodiment.

For example, as in the above-described first embodiment, when the operator operates the stop button on the operation panel 34 during the on-load operation mode, the on-load operation mode is switched to the no-load operation mode. Then, when the ejection pressure Pd is equal to or lower than the drying upper limit pressure Pk, the no-load operation mode is switched to the dry operation mode. Thereafter, when the duration of the dry operation mode reaches the predetermined time ta, the compressor unit is stopped. Then, until the operation button on the operation panel 34 is operated, the dry operation mode is executed for the predetermined time ta every time the stop time of the compressor unit reaches the predetermined time tp.

Thus, in the present embodiment, the dry operation mode is executed while the compressor unit is stopped. Thus, the interior of the compressor main body 1 can be dried even if dew condensation occurs while the compressor unit is stopped. Therefore, the interior of the compressor main body 1 can be prevented from being corroded while the compressor unit is stopped.

In the above-described first and second embodiments, by way of example, an operation instruction or a stop instruction is input to the arithmetic device 31 in the control panel 3 if the operator operates the operation button or stop button on the operation panel 34. However, the present invention is not limited to this configuration. That is, for example, an operation and stop schedule for the compressor unit may be preset and stored in the storage device 30 in the control panel 3. Then, an operation instruction or a stop instruction may be automatically input in accordance with the schedule. Also in this case, effects similar to those of the above-described embodiments can be exerted.

Furthermore, in the above-described second embodiment, by way of example, the arithmetic device 31 in the control panel 3 executes the dry operation mode every time the stop time of the compression unit reaches the predetermined time tp. However, the present invention is not limited to this configuration. That is, for example, an operation and stop schedule for the compressor unit and the time during the stop period of the compressor unit when the dry operation mode is to be executed may be preset and stored in the storage device 30 in the control panel 3. Then, the dry operation mode may be executed in accordance with the schedule and the time. Alternatively, the following configuration is possible. For example, if the operator operates the stop button on the operation panel 34 while the compressor unit is stopped, an execution instruction for the dry operation mode is input. Then, the dry operation mode may be executed in accordance with the execution instruction. Also in this case, effects similar to those of the above-described second embodiment can be exerted.

A third embodiment of the present invention will be described with reference to FIGS. 9 and 10. In the present embodiment, components equivalent to those in the first embodiment are denoted by the same reference numerals. The description of these components is appropriately omitted.

In the present embodiment, the arithmetic device 31 in the control panel 3 switches to the dry operation mode when the normal no-load operation mode (in other words, the no-load operation mode executed when no stop instruction has been input) has been executed for a preset predetermined time tu. Then, when the dry operation mode has been executed for the preset predetermined time ta, the arithmetic device 31 switches to the halt mode. This control procedure will be described with reference to FIG. 9. FIG. 9 is a flowchart illustrating the contents of control processing executed by the arithmetic device 31 according to the present embodiment.

In step 300, the arithmetic device 31 executes the on-load operation mode. The arithmetic device 31 then proceeds to step 310 to determine whether or not the supply pressure Pd1 detected by the supply pressure sensor 29 is equal to or higher than the maximum pressure PH. For example, if the supply pressure Pd1 is lower than the maximum pressure PH, the result of the determination in step 310 is negative. The arithmetic device 31 returns to step 300 described above to continue the on-load operation mode. On the other hand, for example, if the supply pressure Pd1 is equal to or higher than the maximum pressure PH, the result of the determination in step 310 is affirmative. The arithmetic device 31 thus proceeds to step 320 to switch to the no-load operation mode.

Then, the arithmetic device 31 proceeds to step 330 to determine whether or not the supply pressure Pd1 detected by the supply pressure sensor 29 is equal to or lower than the minimum pressure PL. For example, if the supply pressure Pd1 is equal to or lower than the minimum pressure PL, the result of the determination in step 330 is affirmative. The arithmetic device 31 thus returns to step 300 described above to switch to the on-load operation mode. On the other hand, for example, if the supply pressure Pd1 exceeds the minimum pressure PL, the result of the determination in step 330 is negative. The arithmetic device 31 thus proceeds to step 340 and uses the timer 32 to calculate the duration t3 of the no-load operation mode. The arithmetic device 31 then proceeds to step 350 to determine whether or not the duration t3 of the no-load operation mode is equal to or longer than the preset predetermined time tu. For example, if the duration t3 of the no-load operation mode is shorter than the predetermined time tu, the arithmetic device 31 returns to step 320 described above to repeat a procedure similar to that described above. On the other hand, if the duration t3 of the no-load operation mode is equal to or longer than the predetermined time tu, the arithmetic device 31 shifts to step 360. In step 360, the arithmetic device 31 determines whether or not the ejection pressure Pd detected by the ejection pressure sensor 28 is equal to or lower than the drying upper limit pressure Pk. For example, if the ejection pressure Pd exceeds the drying upper limit pressure Pk, the result of the determination in step 360 is negative. The arithmetic device 31 thus returns to step 320 described above to repeat a procedure similar to that described above. On the other hand, for example, if the ejection pressure Pd is equal to or lower than the drying upper limit pressure Pk, the arithmetic device 31 proceeds to step 370 to switch to the dry operation mode.

Then, the arithmetic device 31 proceeds to step 380 to determine whether or not the supply pressure Pd1 detected by the supply pressure sensor 29 is equal to or lower than the minimum pressure PL. For example, if the supply pressure Pd1 is equal to or lower than the minimum pressure PL, the result of the determination in step 380 is affirmative. The arithmetic device 31 thus returns to step 300 described above to switch to the on-load operation mode. On the other hand, if the supply pressure Pd1 exceeds the minimum pressure PL, the result of the determination in step 380 is negative. The arithmetic device 31 thus proceeds to step 390 and uses the timer 32 to calculate the duration t2 of the dry operation mode. The arithmetic device 31 then proceeds to step 400 to determine whether or not the duration t2 of the dry operation mode is equal to or longer than the preset predetermined time ta. For example, if the duration t2 of the dry operation mode is shorter than the predetermined time ta, the arithmetic device 31 returns to step 370 described above to repeat a procedure similar to that described above. On the other hand, for example, if the duration t2 of the dry operation mode is equal to or longer than the predetermined time ta, the arithmetic device 31 proceeds to step 410 to switch to the halt mode.

The operation of the present embodiment will be described with reference to FIG. 10. FIG. 10 is a time chart for illustrating an operation according to the present embodiment.

Figure 9:
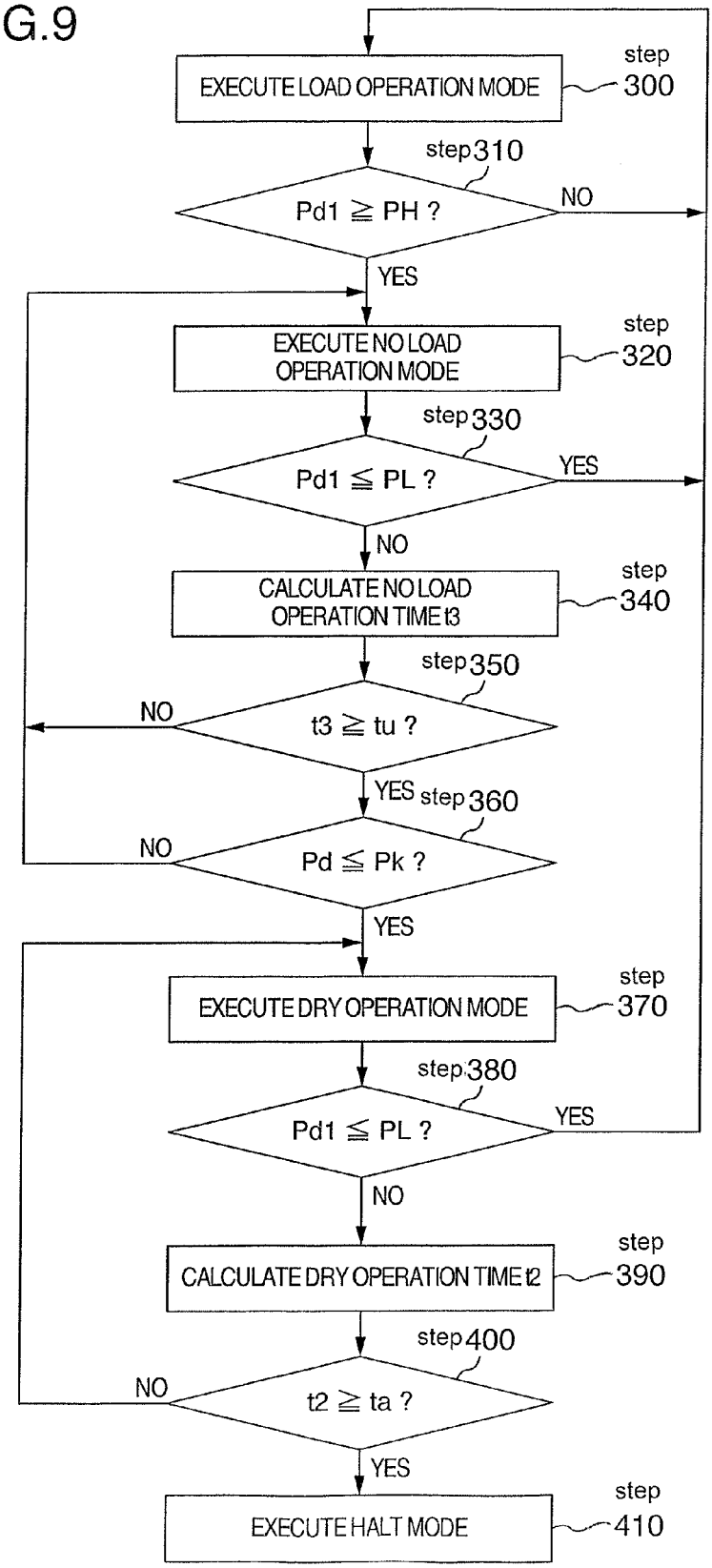
FIG. 9 is a flowchart illustrating the contents of control processing executed by the arithmetic device in the control panel according to a third embodiment of the present invention.
Figure 10:
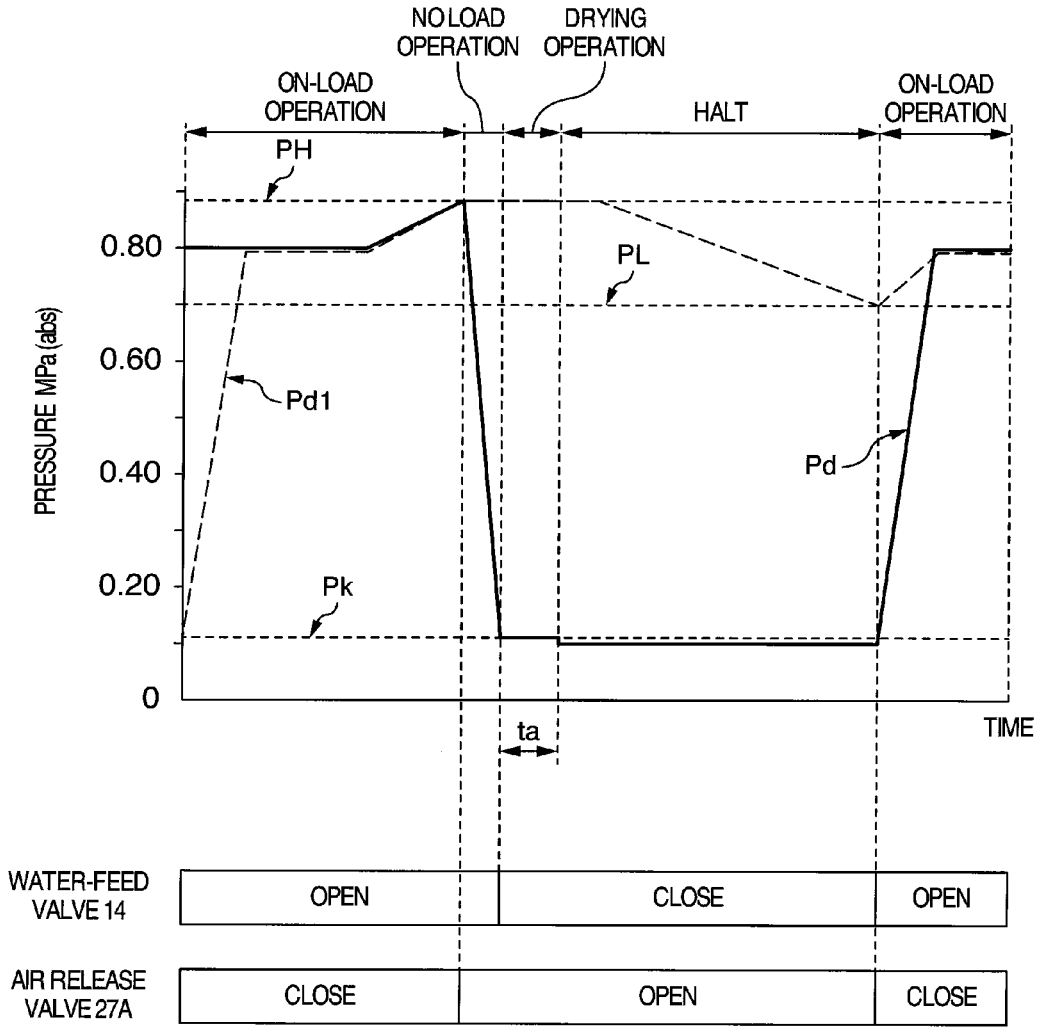
FIG. 10 is a time chart illustrating an operation according to the third embodiment of the present invention.

For example, when the amount of compressed air used by the user decreases and the supply pressure Pd1 reaches the maximum pressure PH during the on-load operation mode, the arithmetic device 31 switches to the no-load operation mode (steps 300 to 320 in FIG. 9 described above). Then, for example, when the duration t3 of the no-load operation mode reaches the predetermined time tu with the supply pressure Pd1 not decreasing to the minimum pressure PL and the ejection pressure Pd is equal to or lower than the drying upper limit pressure Pk, the arithmetic device 31 switches to the dry operation mode (steps 320 to 370 in FIG. 9 described above). Then, for example, when the duration t2 of the dry operation mode reaches the predetermined time ta with the supply pressure Pd1 not decreasing to the minimum pressure PL, the arithmetic device 31 switches to the halt mode (steps 370 to 410 in FIG. 9 described above). Thereafter, for example, when the supply pressure Pd1 decreases to the minimum pressure PL, the arithmetic device 31 switches to the on-load operation mode.

In the present embodiment, when the duration t3 of the no-load operation mode reaches the predetermined time tu, the arithmetic device 31 switches to the dry operation mode. When the duration t2 of the dry operation mode reaches the predetermined time ta, the arithmetic device 31 switches to the halt mode. That is, the interior of the compressor main body 1 can be dried by executing the dry operation mode before halting the compressor main body 1. Therefore, the interior of the compressor main body 1 can be prevented from being corroded during the halt mode.

Furthermore, in the present embodiment, the arithmetic device 31 switches to the dry operation mode when both the following conditions are met: the duration t3 of the no-load operation mode reaches the predetermined time tu, and the ejection pressure Pd is equal to or lower than the drying upper limit pressure Pk. Thus, like the above-described first embodiment, the present embodiment can suppress possible adverse effects on compression performance.

Although not particularly described in the third embodiment, the arithmetic device 31 in the control panel 3 may determine whether or not the ejection pressure Pd exceeds the drying upper limit pressure Pk during the dry operation mode and switch to the no-load operation mode if the ejection pressure Pd exceeds the drying upper limit pressure Pk. Moreover, for example, the following procedure is possible. If the number of times that the dry operation mode has been interrupted and switched to the no-load operation mode reaches a specified value, the compressor unit is stopped and a liquid crystal screen or an indicator light provided on the operation panel 34 (or transmission of a signal to a remote location) may be used to issue an alarm.

Furthermore, in the above-described third embodiment, the following control arrangement has been described by way of example. The arithmetic device 31 in the control panel 3 switches to the dry operation mode when both the following conditions are met: the duration t3 of the no-load operation mode reaches the predetermined time tu, and the ejection pressure Pd detected by the ejection pressure sensor 28 is equal to or lower than the drying upper limit pressure Pk. However, the present invention is not limited to this configuration. That is, for example, as shown in FIG. 6 described above, the ejection temperature sensor 35 configured to detect the ejection temperature Td of the compressor main body 1 may be provided. Then, the arithmetic device 31 in the control panel 3 may switch to the dry operation mode when both the following conditions are met: the duration t3 of the no-load operation mode reaches the predetermined time tu, and the ejection temperature Td detected by the ejection temperature sensor 35 is equal to or lower than the drying upper limit temperature Tk. Alternatively, the arithmetic device 31 may determine whether or not the ejection temperature Td detected by the ejection temperature sensor 35 is equal to or lower than the drying upper limit temperature Tk, and switch to the no-load operation mode if the ejection temperature Td exceeds the drying upper limit temperature Tk. Moreover, for example, the following configuration is possible. If the number of times that the dry operation mode has been interrupted and switched to the no-load operation mode reaches a specified value, the compressor unit is stopped and the liquid crystal screen or indicator light provided on the operation panel 34 (or transmission of a signal to a remote location) may be used to issue an alarm.

Figure 11:
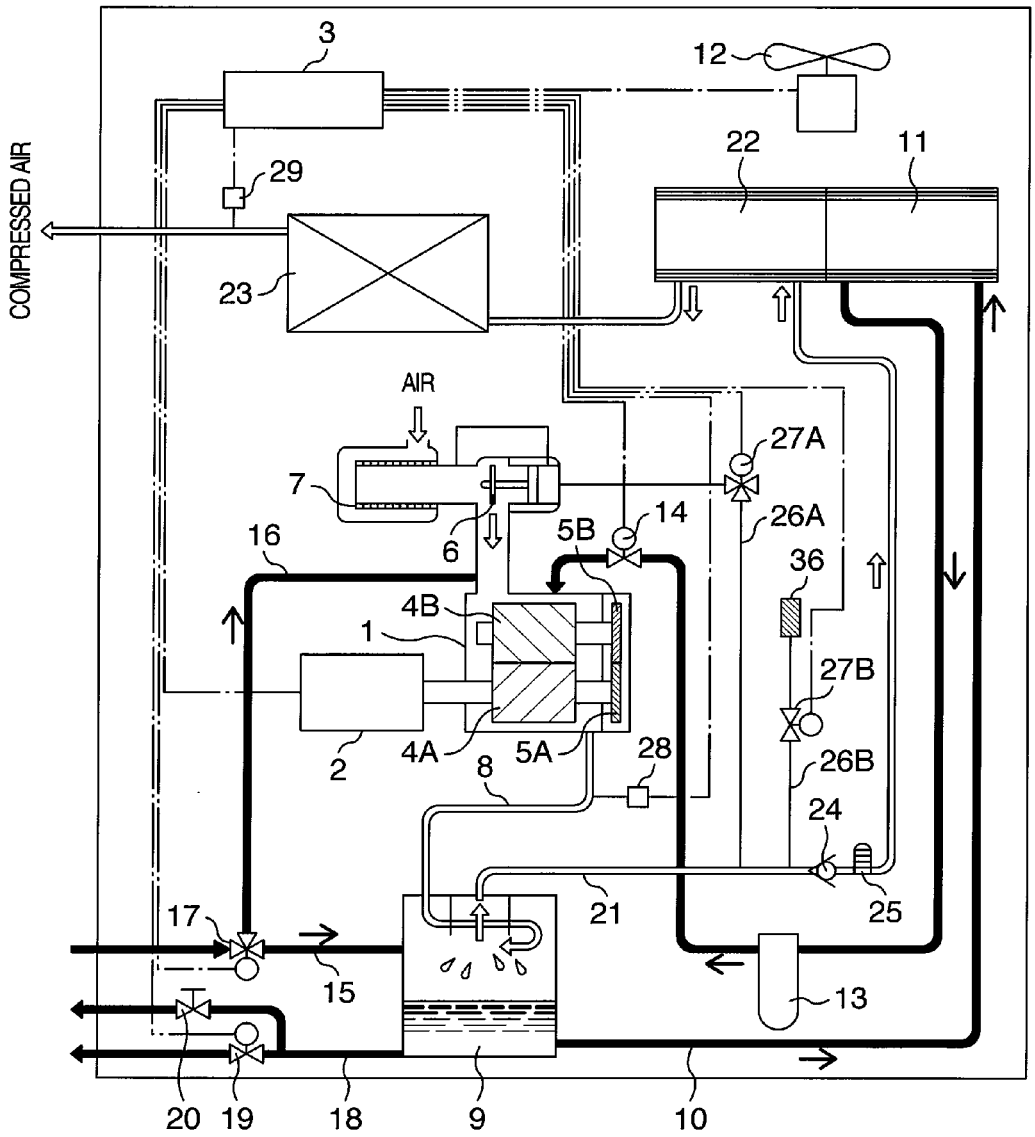
FIG. 11 is a diagram showing the configuration of a water injection air compressor according to a second modification of the present invention.
Figure 12:
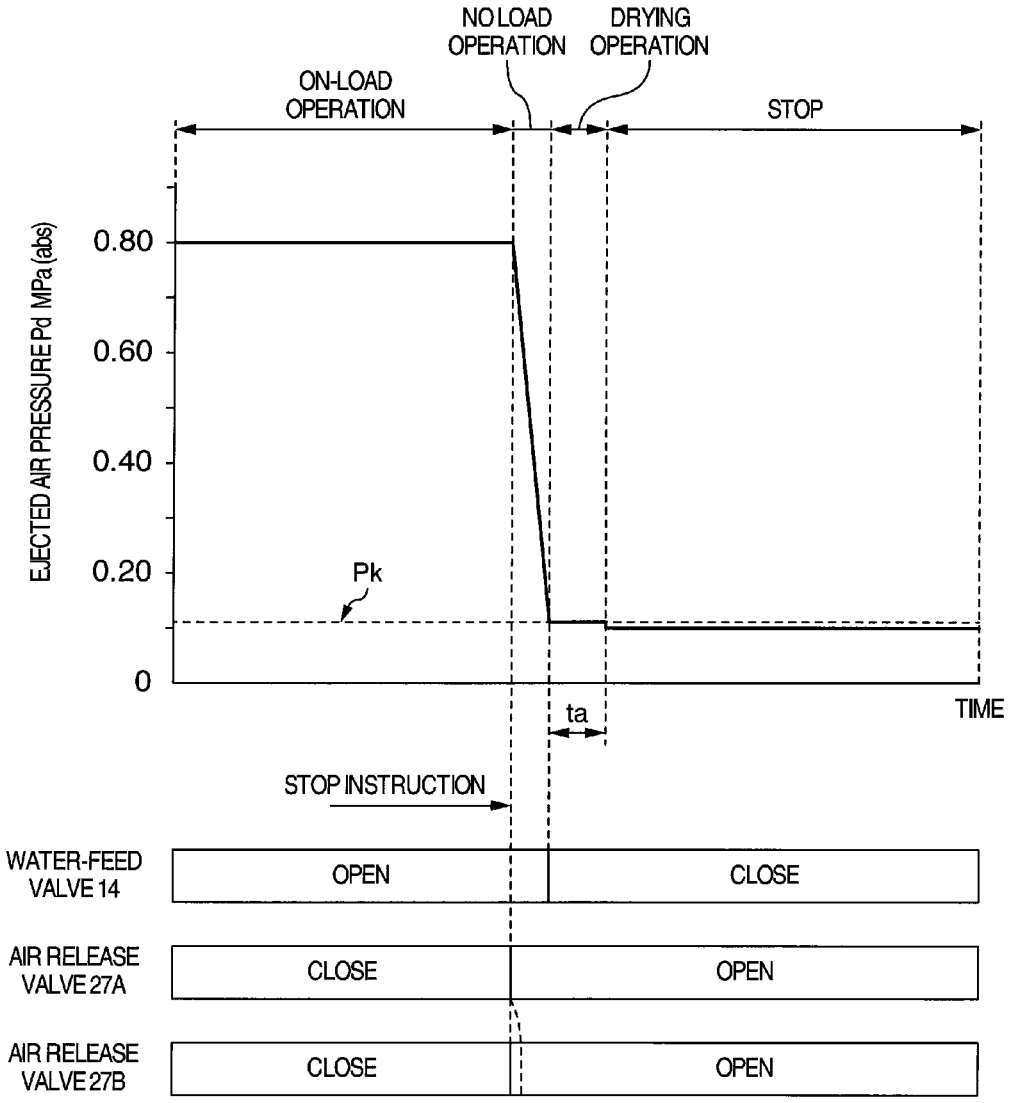
FIG. 12 is a time chart illustrating an operation according to the second modification of the present invention.
Figure 13:
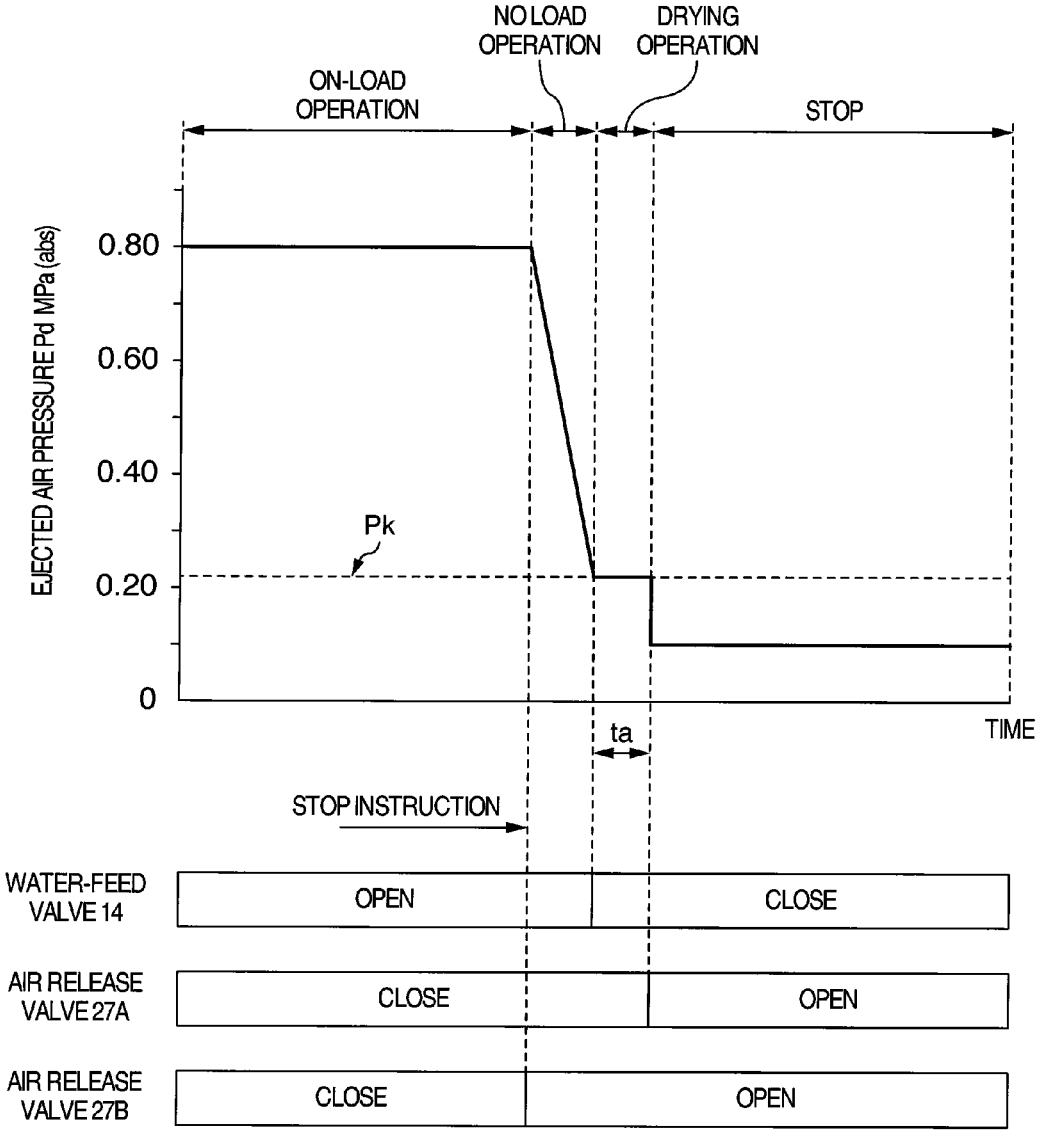
FIG. 13 is a time chart illustrating another example of operation according to the second modification of the present invention.

In the above description, as shown in FIG. 1 described above, one air release valve 27A is provided in the water injection compressor, by way of example. However, the present invention is not limited to this configuration. That is, for example, as shown in FIG. 11, an air release pipe 26B that branches upstream of the check valve 24 in the compressed air pipe 21 may be additionally provided. Furthermore, an air release valve 27B may be provided which is configured to be able to release compressed air to the air release pipe 26B. The air release valve 27B is not interlocked with the suction throttle valve 6 but enables air to be released via a silencer 36. Then, for example, as shown in FIG. 12, to switch from the on-load operation mode to the no-load operation mode, the control panel 3 may simultaneously open the air release valves 27A and 27B or may open the air release valve 27A, and a short time later, open the air release valve 27B. This allows an air release speed to be increased and enables the ejection pressure Pd to be quickly reduced during the no-load operation mode so that the no-load operation mode can be switched to the dry operation mode. Furthermore, for example, as shown in FIG. 13, the following configuration is possible. In the no-load operation mode and the dry operation mode, the air release valve 27A is closed (and the suction throttle valve 6 is open), and the air release valve 27B is open. While the compressor unit is stopped (or in the halt mode), the both the air release valves 27A and 27B may be open. In such a control method as shown in FIG. 13, in the no-load operation mode and the dry operation mode, the suction pressure PS=0.10 MPa (abs). Thus, the drying upper limit pressure Pk can be set to a larger value of 0.22 MPa (abs). Hence, the control panel 3 can switch to the dry operation mode earlier. As a result, energy can also be saved.

Figure 14:
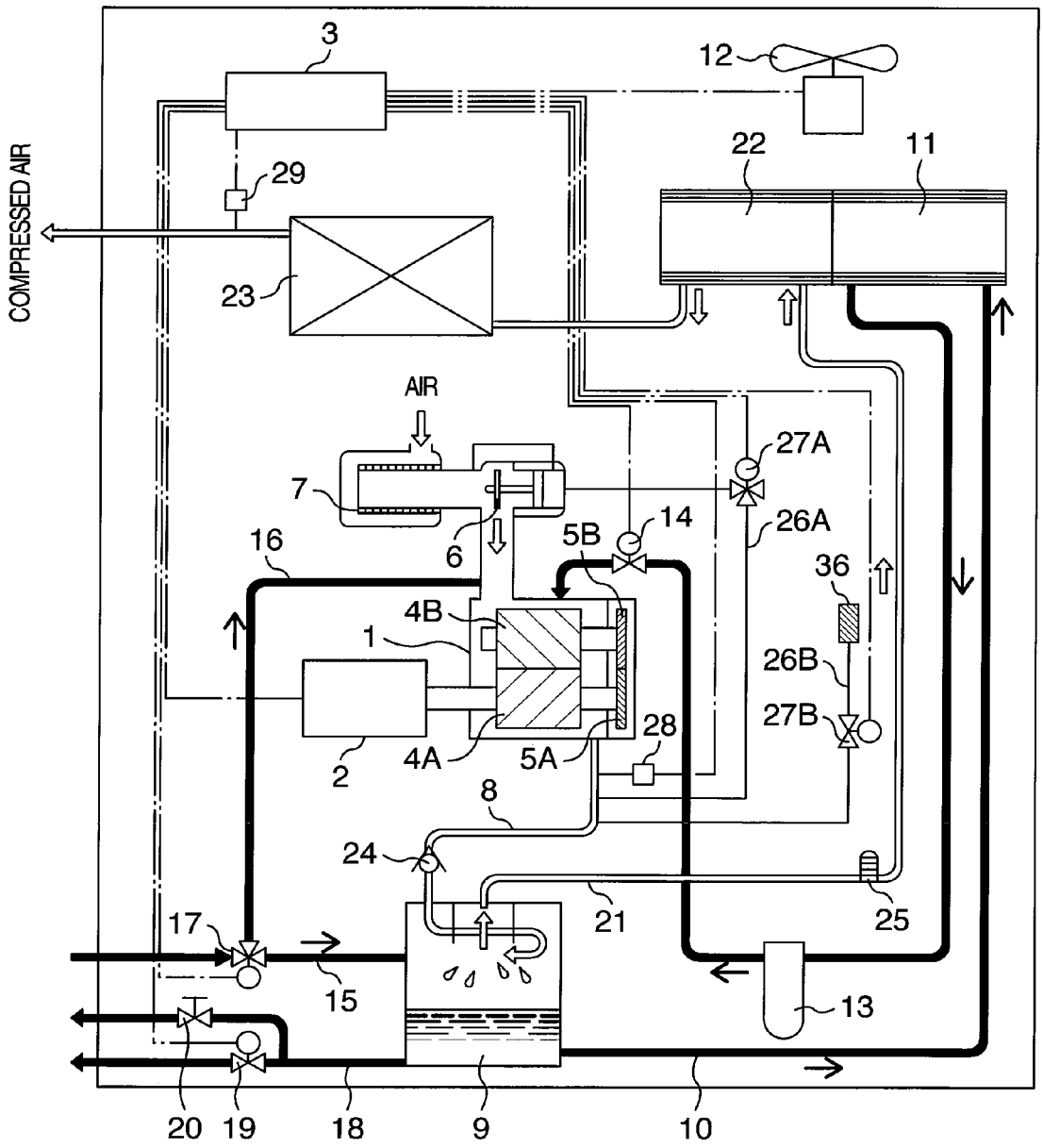
FIG. 14 is a diagram showing the configuration of a water injection air compressor according to a third modification of the present invention.

Furthermore, in the above description, as shown in FIG. 1 (and FIG. 4) described above, the check valve 24 is provided on the secondary side of the separator tank 9, and the air release pipe 26A (and air release pipe 268) that branches upstream of the check valve 24 is provided, by way of example. However, the present invention is not limited to this configuration. That is, for example, as shown in FIG. 14, the check valve 24 may be provided on the primary side of the separator tank 9, and the air release pipe 26A (and air release pipe 26B) that branches upstream of the check valve 15 may be provided. This allows the amount of air released via the air release valve 27A (and air release valve 27B) to be reduced and enables the ejection pressure Pd to be quickly reduced during the no-load operation mode so that the no load operation can be switched to the dry operation mode. As a result, energy can also be saved. Additionally, if the check valve 24 is provided on the primary side of the separator tank 9, the need for the suction throttle valve 6 may be eliminated, and the air release valve 27A (and air release valve 27B) may be open to release air to the atmosphere.

Furthermore, in the above description, the ejection pressure sensor 28 (and the ejection temperature sensor 35) is provided on the primary side of the separator tank 9, by way of example. However, the present invention is not limited to this configuration. For example, the ejection pressure sensor 28 (and the ejection temperature sensor 35) may be provided on the secondary side of the separator tank 9. Additionally, in the above description, the supply pressure sensor 29 is provided inside the compressor unit, by way of example. However, the present invention is not limited to this configuration. The supply pressure sensor 29 may be provided outside the compressor unit. Moreover, in the above description, the ejection pipe 8 configured to connect the compressor main body 1 to the separator tank 9 is provided, by way of example. However, the present invention is not limited to this configuration. The compressor main body 1 may be connected directly to the separator tank 9. Furthermore, in the above description, the water cooler 11 is of an air cooling type, by way of example. However, the present invention is not limited to this configuration. The water cooler 11 may be of a water cooling type. In addition, the air release pipe 26A (and air release pipe 26B) may include a collection device configured to collect water contained in released air.

Furthermore, in the above description, an application target of the present invention is the water injection air compressor configured to variably control the rotation number of the motor 2, by way of example. However, the present invention is not limited to this application and may be applied to a water injection air compressor with the rotation number of the motor 2 fixed. In the above description, another application target of the present invention is the water injection air compressor including the screw-shaped compressor main body 1, by way of example. However, the present invention is not limited to this application and may be applied to a water injection air compressor including a compressor main body in any other type.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An air compressor of water injection type comprising:

a compressor body including an actuation chamber to compress air in the actuation chamber, a water feed line for supplying water into the actuation chamber, an air release valve for discharging the compressed air from the actuation chamber, and a control panel for controlling the water feed line and the air release valve to select one of an on-load operation mode in which the water is supplied into the actuation chamber through the water feed line while preventing the compressed air from being discharged from the actuation chamber through the air release valve and a no-load operation mode in which the water is supplied into the actuation chamber through the water feed line while allowing the compressed air to be discharged from the actuation chamber through the air release valve, wherein the control panel is capable of controlling the water feed line and the air release valve to execute, as substitute for the no-load operation mode and the on-load operation mode, a dry operation mode in which the water is prevented from being supplied into the actuation chamber through the water feed line while allowing the compressed air to be discharged from the actuation chamber through the air release valve, wherein the control panel executes the dry operation mode before a stoppage of compression in the actuation chamber in response to a stop instruction, and wherein the control panel includes a pressure detector for measuring a pressure of the compressed air discharged from the actuation chamber, and the control panel executes in response to the stop instruction the no-load operation mode when the measured pressure is more than a predetermined threshold value, and executes the dry operation mode before preventing the compression in the actuation chamber after the measured pressure becomes not more than the predetermined threshold value.

2. An air compressor of water injection type comprising:

a compressor body including an actuation chamber to compress air in the actuation chamber, a water feed line for supplying water into the actuation chamber, an air release valve for discharging the compressed air from the actuation chamber, and a control panel for controlling the water feed line and the air release valve to select one of an on-load operation mode in which the water is supplied into the actuation chamber through the water feed line while preventing the compressed air from being discharged from the actuation chamber through the air release valve and a no-load operation mode in which the water is supplied into the actuation chamber through the water feed line while allowing the compressed air to be discharged from the actuation chamber through the air release valve, wherein the control panel is capable of controlling the water feed line and the air release valve to execute, as substitute for the no-load operation mode and the on-load operation mode, a dry operation mode in which the water is prevented from being supplied into the actuation chamber through the water feed line while allowing the compressed air to be discharged from the actuation chamber through the air release valve, wherein the control panel executes the dry operation mode before a stoppage of compression in the actuation chamber in response to a stop instruction, and wherein the control panel includes a temperature detector for measuring a temperature of the compressed air discharged from the actuation chamber, and the control panel executes in response to the stop instruction the no-load operation mode when the measured temperature is more than a predetermined threshold value, and executes the dry operation mode before preventing the compression in the actuation chamber after the measured temperature becomes not more than the predetermined threshold value.

3. An air compressor of water injection type comprising:

a compressor body including an actuation chamber to compress air in the actuation chamber, a water feed line for supplying water into the actuation chamber, an air release valve for discharging the compressed air from the actuation chamber, and a control panel for controlling the water feed line and the air release valve to select one of an on-load operation mode in which the water is supplied into the actuation chamber through the water feed line while preventing the compressed air from being discharged from the actuation chamber through the air release valve and a no-load operation mode in which the water is supplied into the actuation chamber through the water feed line while allowing the compressed air to be discharged from the actuation chamber through the air release valve, wherein the control panel is capable of controlling the water feed line and the air release valve to execute, as substitute for the no-load operation mode and the on-load operation mode, a dry operation mode in which the water is prevented from being supplied into the actuation chamber through the water feed line while allowing the compressed air to be discharged from the actuation chamber through the air release valve, and wherein the control panel executes the dry operation mode after the control panel executes the no-load operation mode for a first predetermined time period, and prevents the compression in the actuation chamber after the control panel executes the dry operation mode for a second predetermined time period.

4. An air compressor of water injection type comprising:

a compressor body including an actuation chamber to compress air in the actuation chamber, a water feed line for supplying water into the actuation chamber, an air release valve for discharging the compressed air from the actuation chamber, and a control panel for controlling the water feed line and the air release valve to select one of an on-load operation mode in which the water is supplied into the actuation chamber through the water feed line while preventing the compressed air from being discharged from the actuation chamber through the air release valve and a no-load operation mode in which the water is supplied into the actuation chamber through the water feed line while allowing the compressed air to be discharged from the actuation chamber through the air release valve, wherein the control panel is capable of controlling the water feed line and the air release valve to execute, as substitute for the no-load operation mode and the on-load operation mode, a dry operation mode in which the water is prevented from being supplied into the actuation chamber through the water feed line while allowing the compressed air to be discharged from the actuation chamber through the air release valve, wherein the control panel executes the dry operation mode before a stoppage of compression in the actuation chamber in response to a stop instruction, and wherein the control panel includes a pressure detector for measuring a pressure of the compressed air discharged from the actuation chamber, and the control panel executes the dry operation mode after the control panel executes the no-load operation mode for a first predetermined time period and the measured pressure becomes not more than a predetermined threshold value.

5. The air compressor of water injection type according to claim 4, wherein the control panel executes the no-load operation mode in response to that the measured pressure becomes more than the predetermined threshold value during executing the dry operation mode.

6. An air compressor of water injection type comprising:

a compressor body including an actuation chamber to compress air in the actuation chamber, a water feed line for supplying water into the actuation chamber, an air release valve for discharging the compressed air from the actuation chamber, and a control panel for controlling the water feed line and the air release valve to select one of an on-load operation mode in which the water is supplied into the actuation chamber through the water feed line while preventing the compressed air from being discharged from the actuation chamber through the air release valve and a no-load operation mode in which the water is supplied into the actuation chamber through the water feed line while allowing the compressed air to be discharged from the actuation chamber through the air release valve, wherein the control panel is capable of controlling the water feed line and the air release valve to execute, as substitute for the no-load operation mode and the on-load operation mode, a dry operation mode in which the water is prevented from being supplied into the actuation chamber through the water feed line while allowing the compressed air to be discharged from the actuation chamber through the air release valve, wherein the control panel executes the dry operation mode before a stoppage of compression in the actuation chamber in response to a stop instruction, and wherein the control panel includes a temperature detector for measuring a temperature of the compressed air discharged from the actuation chamber, and the control panel executes the dry operation mode after the control panel executes the no-load operation mode for a first predetermined time period and the measured temperature becomes not more than a predetermined threshold value.

7. The air compressor of water injection type according to claim 6, wherein the control panel executes the no-load operation mode in response to that the measured temperature becomes more than the predetermined threshold value during executing the dry operation mode.

* * * * *